US005557817A

United States Patent [19]

Haddock

[11] Patent Number: 5,557,817

[45] Date of Patent: Sep. 24, 1996

[54] PROTECTIVE COVER FOR HOSPITAL BED RAILS

[76] Inventor: Henry J. Haddock, 866 Eldorado Ave., Clearwater Beach, Fla. 34630

[21] Appl. No.: 502,488

[22] Filed: Jul. 14, 1995

[51] Int. Cl.[6] ..... A47C 21/08

[52] U.S. Cl. ..... 5/663; 5/425; 5/922

[58] Field of Search ..... 5/424, 425, 494, 5/663, 93.1, 922

[56] References Cited

U.S. PATENT DOCUMENTS

| | | | |
|---|---|---|---|
| 1,474,738 | 11/1923 | Thierjung | 5/494 X |
| 2,677,834 | 5/1954 | Moynihan | 5/494 X |
| 3,241,158 | 3/1966 | Berl | 5/93.1 |
| 3,742,530 | 7/1973 | Clark | 5/663 X |
| 4,215,446 | 8/1980 | Mahoney | 5/663 X |
| 4,827,545 | 5/1989 | Arp | 5/663 X |
| 5,450,641 | 9/1995 | Montgomery | 5/663 |

*Primary Examiner*—Michael F. Trettel
*Attorney, Agent, or Firm*—Harold D. Shall

[57] ABSTRACT

A protective cover for removable placement over the restraining side rails of a hospital bed. The cover is made of a foamed plastic core covered by a soft material with the cover being foldable over the top of the side rail and hook and eye means positioned at each end and at the sides of the cover to secure the cover on the side rail.

2 Claims, 3 Drawing Sheets

PROTECTIVE COVER FOR HOSPITAL BED RAILS

BACKGROUND OF THE INVENTION

1. Field of The Invention

This invention relates to a protective cover for hospital bed side rails generally and more particularly to such a cover which is adjustable in its fit and can be easily installed.

2. Description of Prior Art

Protective covers of the prior art comprise form fitting slipcovers which secure about a bed side rail such as shown in U.S. Pat. Nos. 5,044,025; 5,097,550 and 5,175,897. These patented covers closely fit the side rails and are not adjustable to fit rails of different sizes or, for example, when the bed has two axial aligned side rails on each side, require two separate covers and if such a bed has one long side rail, two of the shorter covers cannot be used, but require a long cover to fit the long rail. Theses devices require the hospital to have a larger inventory of covers to fit all the different side rails they have in their facility. The prior art also includes blankets held in place by masking tape; however, these crude devices are not convenient or expeditious to use, nor do they function in a satisfactory manner.

SUMMARY OF THE INVENTION

This invention is a protective cover which is adapted for removable placement over the restraining side rails of a hospital bed. The protective cover is made from a core of cushioning material such as closed cell polyurethane foam. Over the core is an outer layer made from a soft material such as bed sheeting (eg 150 to 200 thread percale). The length of the cover is dimensional so as to be slightly longer than the usual length of the side rail and the width of the cover is twice the distance between the top of the side rail and the usual rung that is halfway between the top of the side rail and bottom rung of the side rail.

Attached to each end of the cover adjacent one side thereof is a pair of "hook" strips (referred to as Velcro® strips) and adjacent the other side thereof at each end is a pair of "eye" strips (referred to as Velcro®, strips) so that when the cover is placed with its medial portion over the top rung of the side rail and bent down on both sides, the hook strips each became aligned with an eye strip and can be secured thereto to control the fit of the ends of the cover over the ends of the side rail. With the cover unfolded, attached to one side thereof are a pair of spaced hook strips, while attached to the other side are a pair of eye strips, so that when the cover is placed with its medial portion over the top rung of the side rail and bent down on both side, the hook and eye strips can be extended under the usual rung that is half way between the top and bottom of the side rail.

If necessary, two of the covers can be axially aligned and the hook strips at the end of one cover can be aligned and secured to the eye strip at the end of the other cover, whereby a double length cover is provided to fit over a double length side rail.

DETAILED DESCRIPTION OF THE PREFERRED EMBODIMENT

Figure 5:
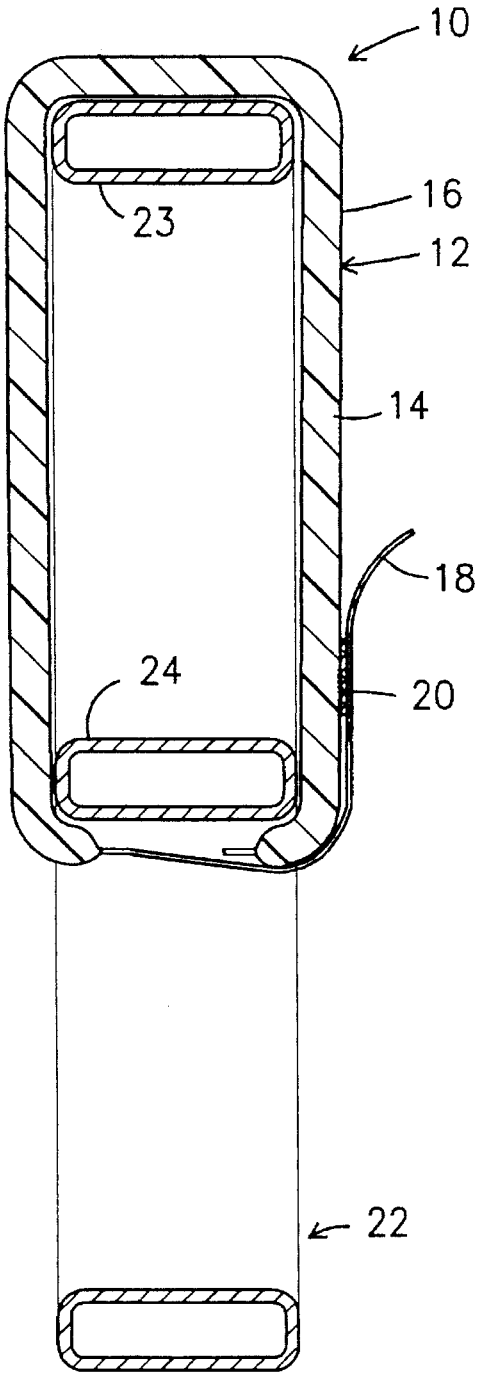
FIG. 5 is a view taken along the liens 5—5 in FIG. 4.

Referring now to the drawings, a protective cover for a hospital bed side rail is shown generally at 10 and includes a body portion 12. As seen in FIG. 5, the body portion 12 comprises a core 14 made of a closed cell plastic resilient foam such as furniture grade polyurethane foam, with the core being covered on all sides by a continuous piece of material 16 such as bed sheeting (eg 150 to 200 thread percale) which has all its adjoinive sides sewn together to form an enclosed cover.

Figure 3:
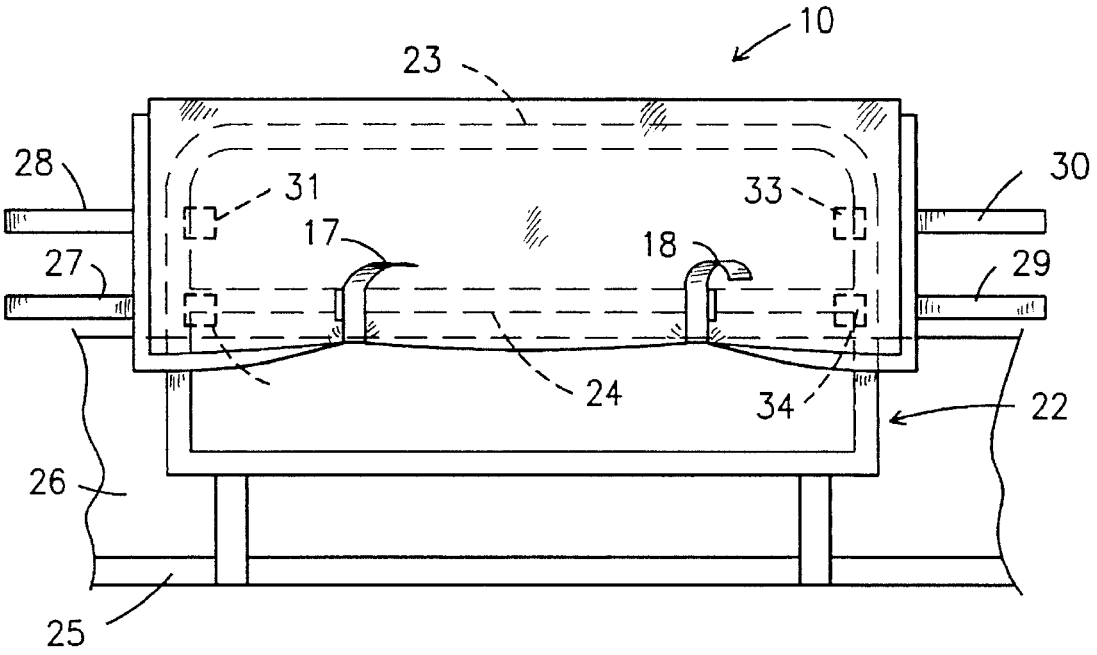
FIG. 3 is a side elevational view of a cover partially installed on a side rail with the bottom hook and eye strip secured.
Figure 4:
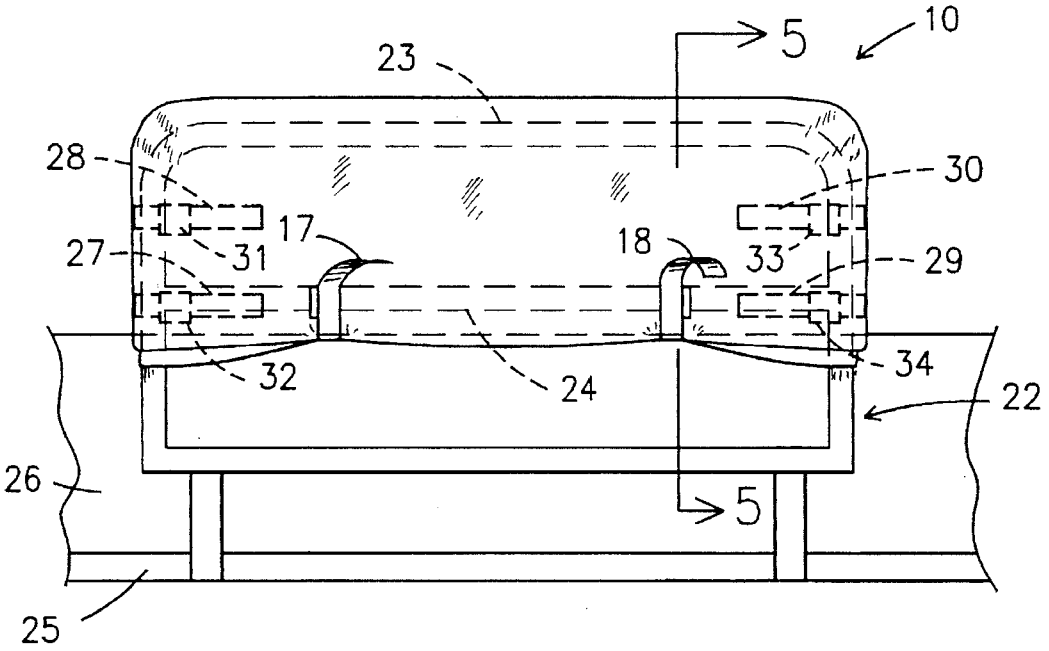
FIG. 4 is a side elevational view of a cover fully installed on a side rail with all its hook and eye strips secured.

Attached to the cover, as by sewing, are a plurality of cooperating hook and eye strips. More particularly referring to FIGS. 1, 2 and 5 the cover 10 includes a pair of a longitudinal spaced side hook strips 17 and 18 extending laterally upwardly therefrom, cooperatively positioned with a pair of longitudinally spaced eye strips 19 and 20 secured to the soft material 16 adjacent the side of the cover 10 opposite the strips 17 and 18. Thus, when the cover 10 is moved to its position shown in FIG. 2, adjoining the side rail assembly 22, and then folded over the top rung 23 as shown in FIGS. 3, 4 and 5, the hook strips 17 and 18 can be passed under the middle rung 24 of the side rail assembly 22 and secured to the eye strips 19 and 20 thus securing the bottom edge of the cover 10 to the side rail 22. The side rail 22 is carried, in a well known manner, by a bed frame shown fragmentarily at 25, which frame also supports a conventional mattress shown fragmentarily at 26.

Figure 1:
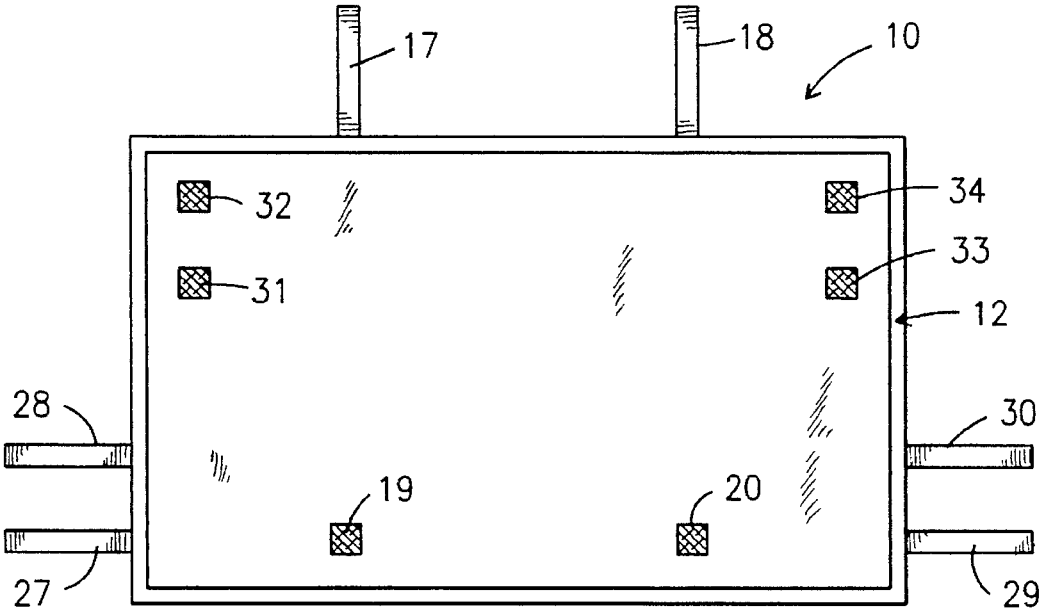
FIG. 1 is a plan view, of a cover according to this invention shown in its un-installed unfolded condition.
Figure 2:
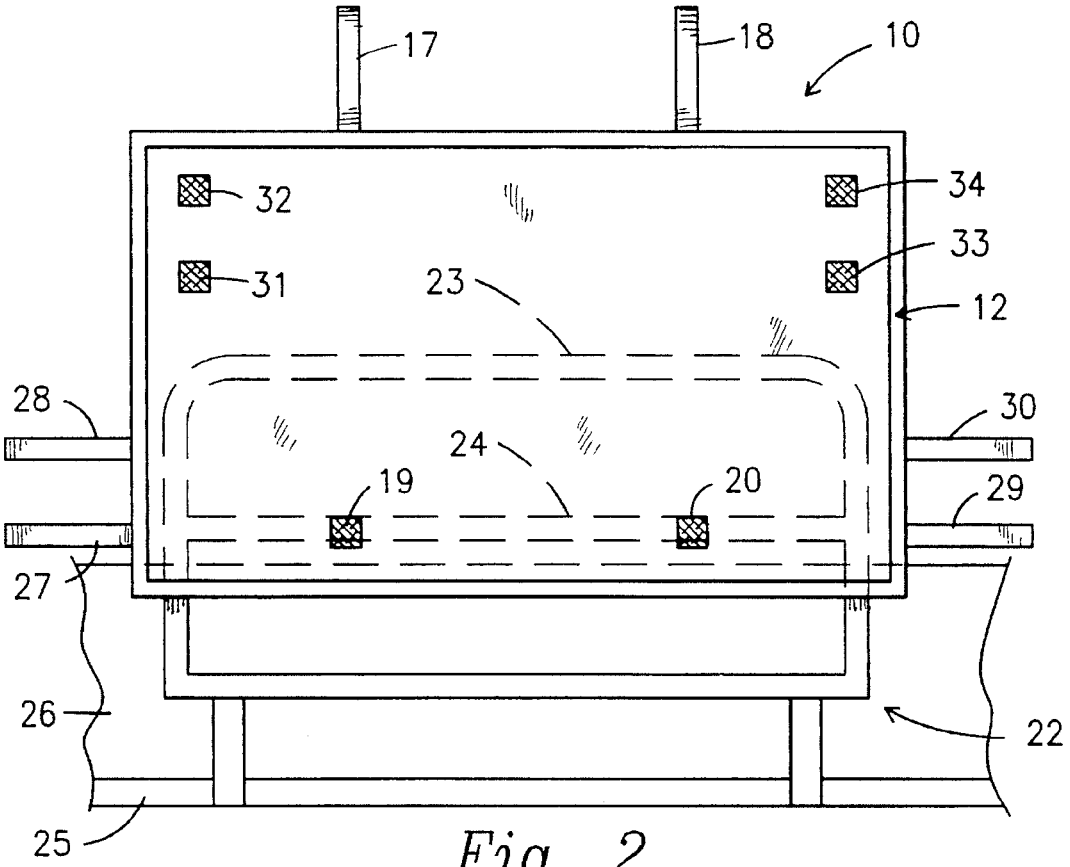
FIG. 2 shows a cover like FIG. 1 next to a side rail ready to be installed therein.

As seen in FIGS. 1 and 2, the cover 10 also includes two pair of end hook strips, with one of the pairs shown at 27 and 28 extending to the left of the cover from adjacent its lower end and the other of the pairs shown at 29 and 30 extending to right of the cover from adjacent its lower end. On the left end of the cover adjacent its upper side are a pair of eye strips 31 and 32 and on its right end adjacent its upper side are a pair of eye strips 33 and 34. When the cover 20 is placed on the rail assembly 22, the strips 27, 28, 29 and 30 are respectively secured to the end eye strips 32, 31, 34 and 33 to thus secure the ends of the cover 10 around the rail assembly 22. Since the hook strips are elongated they provide adjustment for differing length rail assemblies. Further the ends of the cover are wrapped around the ends of the rail assembly to provide protection therefrom.

Figure 6:
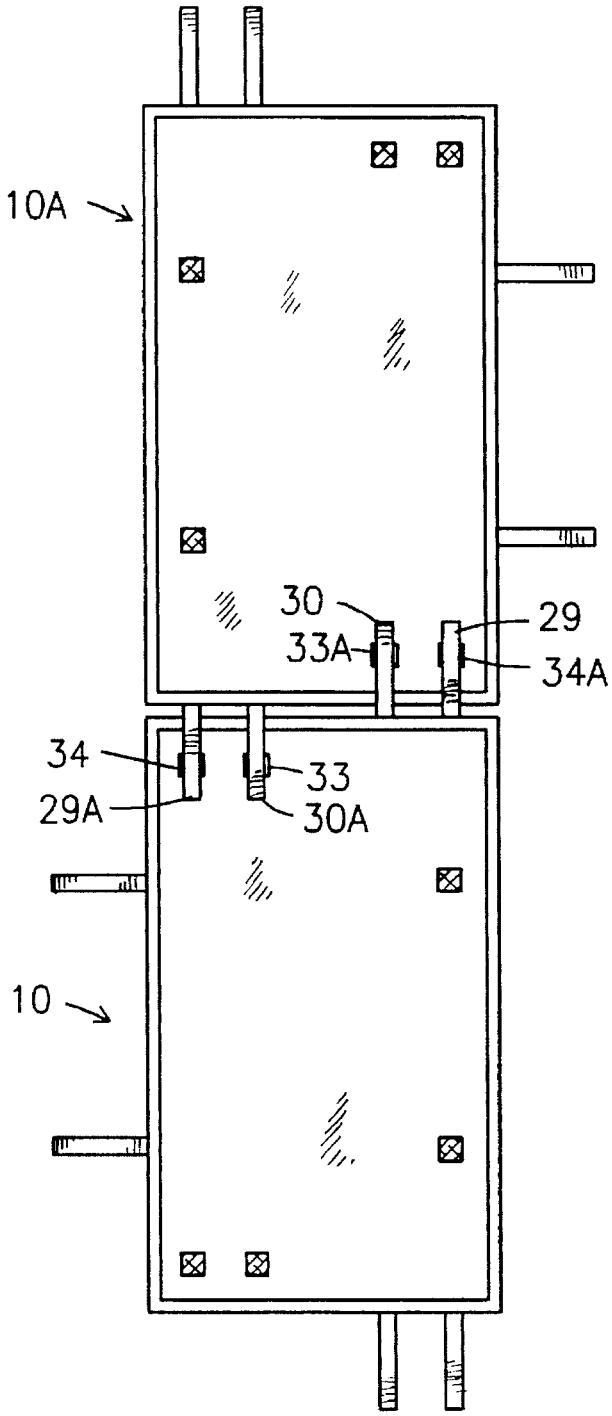
FIG. 6 is a plan view showing two covers end to end and secured together.

The cover shown in FIG. 1–5 fits a single rail. Usually in a hospital bed there are two single rails on each side of the bed and the cover of FIGS. 1–5 can be placed on each of the single rails. Sometimes, a hospital bed may have one elongated rail on each side of the bed. In such a case, the prior art covers of U.S. Pat. No. 5,097,550 would have to be tailored to fit the entire length of the elongated rail. With the cover of the instant invention two covers can be secured together, as shown, in FIGS. 6 to form an elongated cover to fit such an elongated rail. Thus a first cover, as shown at 10, is placed adjacent a second cover, as shown at 10A, so that the strips 29 and 30 of the cover 10 are secured to the eye strips 34A and 33A respectively and the strips 29A and 30A of the cover 10A are secured to the eye strips 34 and 33 respectively.

Although the above description relates to a presently preferred embodiment, numerous changes can be made therein without departing from the scope of this invention as claimed in the following claims.

What is claimed is:

1. A protective cover adapted for removable placement on the side rails of a hospital bed comprising, a) a flexible core which is slightly longer than it is wide and which is made of a cushioning plastic foam material, b) an outer layer of soft cloth material overlying the entirety of said core, c) a first pair of side hook and eye means secured to the elongated sides of the outer layer and, at such time as said cover is placed over the top of a side rail and bent downwardly, said first hook and eye means being securable together, d) a first and a second pair of hook means secured to the ends of said outer layer, with said first pair of end hook means being opposed to said second pair of end hook means, and, e) a first and second pair of end eye means secured to the ends of said outer layer, with said first pair of end eye means being opposed to said second pair of end eye means;

f) said first end eye means being secured to the same end of said cover as said end first hook means and said second end eye means being secured to the same end of said cover as said second hook means, whereby when said cover is placed over a side rail said first end hook and eye means can be secured to each other around a first end of the side rail and said second end hook and eye means can be secured to each other around the end of the side rail opposite the first end.

2. A protective cover according to a claim 1 wherein said end hook and eye means of one of said covers are alignable and securable with the end hook and eye means of a second of said covers when said first and second covers are placed end to end.

* * * * *